US008070419B2

(12) United States Patent
Helmer et al.

(10) Patent No.: US 8,070,419 B2
(45) Date of Patent: Dec. 6, 2011

(54) SPIRAL PUMPING STAGE AND VACUUM PUMP INCORPORATING SUCH PUMPING STAGE

(75) Inventors: John C. Helmer, Eugene, OR (US); Silvio Giors, Turin (IT)

(73) Assignee: Agilent Technologies, Inc., Santa Clara, CA (US)

( * ) Notice: Subject to any disclaimer, the term of this patent is extended or adjusted under 35 U.S.C. 154(b) by 525 days.

(21) Appl. No.: 12/343,980

(22) Filed: Dec. 24, 2008

(65) Prior Publication Data

US 2010/0158672 A1 Jun. 24, 2010

(51) Int. Cl.
*F01D 1/36* (2006.01)

(52) U.S. Cl. ..... 415/90

(58) Field of Classification Search ..... 415/290; 417/201

See application file for complete search history.

(56) References Cited

U.S. PATENT DOCUMENTS 2,954,157 A * 9/1960 Eckberg ..... 415/90
2,958,454 A * 11/1960 Hummer ..... 137/565.23
3,104,802 A * 9/1963 Eckberg ..... 417/49
3,248,755 A * 5/1966 Plymale ..... 366/99
3,355,764 A * 12/1967 Moyer ..... 425/587
3,829,270 A * 8/1974 DeBonth et al. ..... 425/381.2
3,969,039 A * 7/1976 Shoulders ..... 417/244
4,090,815 A * 5/1978 Nakamura ..... 417/203
4,255,081 A * 3/1981 Oklejas et al. ..... 415/90
4,655,678 A * 4/1987 Miki ..... 415/71
4,668,160 A * 5/1987 Mase et al. ..... 415/90
5,542,828 A * 8/1996 Grenci et al. ..... 418/1
5,547,338 A * 8/1996 Conrad et al. ..... 415/90
5,688,106 A * 11/1997 Cerruti et al. ..... 415/90
5,695,316 A * 12/1997 Schutz et al. ..... 415/90
5,848,873 A * 12/1998 Schofield ..... 415/90
6,375,413 B1 * 4/2002 Stones ..... 415/90
6,394,747 B1 * 5/2002 Hablanian ..... 415/55.1
6,672,827 B2 * 1/2004 Yamashita et al. ..... 415/90
6,866,488 B2 * 3/2005 Olivier et al. ..... 417/423.4
7,160,081 B2 * 1/2007 Rival ..... 415/199.6
7,175,383 B2 * 2/2007 Stones et al. ..... 415/55.4
7,500,822 B2 * 3/2009 Huntley et al. ..... 415/90
7,614,844 B2 * 11/2009 Schofield ..... 415/90
2002/0018712 A1 * 2/2002 Schofield ..... 415/121.2
2003/0077187 A1 * 4/2003 Kabasawa et al. ..... 417/322
2005/0047904 A1 * 3/2005 Rival ..... 415/90
2007/0059156 A1 * 3/2007 Blanchard et al. ..... 415/90
2007/0140833 A1 * 6/2007 Schofield ..... 415/90
2008/0112790 A1 * 5/2008 Beyer et al. ..... 415/55.1
2009/0196734 A1 * 8/2009 Kawashima et al. ..... 415/90
2010/0068054 A1 * 3/2010 Tollner et al. ..... 415/229
2010/0104428 A1 * 4/2010 Tollner et al. ..... 415/173.1
2010/0158667 A1 * 6/2010 Helmer et al. ..... 415/97
2010/0158672 A1 * 6/2010 Helmer et al. ..... 415/120

* cited by examiner

FOREIGN PATENT DOCUMENTS

GB 332879 7/1930

*Primary Examiner* — Ross Gushi

(57) ABSTRACT

A molecular spiral-type vacuum pumping stage comprises a smooth surfaces rotor disk cooperating with a stator body. The stator body comprises a plurality of spiral channels on at least one surface facing the rotor disk. The cross-section area (σ) of these channels are reduced from the center to the outer periphery of the stator body so that the condition is satisfied according to which the internal channel speed, i.e. the product of the channel cross-section area and half the rotor velocity normal to the aforesaid area, is constant throughout the channels. Due to this arrangement, it is possible to avoid the risk of internal compression or re-expansions, this limiting the power losses. The present invention also refers to a vacuum pump comprising at least one pumping stage as described above.

16 Claims, 9 Drawing Sheets

SPIRAL PUMPING STAGE AND VACUUM PUMP INCORPORATING SUCH PUMPING STAGE

CROSS-REFERENCE TO RELATED APPLICATION

This application is related to the application of Varian S.p.A. (Ser. No. 12/343,961) entitled "CENTRIPETAL PUMPING STAGE AND VACUUM PUMP INCORPORTING SUCH PUMPING STAGE"

FIELD OF THE INVENTION

The present invention relates to a spiral pumping stage for vacuum pump. More particularly, the present invention relates to an improved spiral molecular pumping stage and to a vacuum pump comprising the pumping stage.

BACKGROUND OF THE INVENTION

Molecular drag pumping stages produce pumping action by momentum transfer from a fast-moving surface (moving at speed comparable to thermal speed of the molecules) directly to gas molecules. Generally, these pumping stages comprise a rotor and a stator cooperating with each other and defining a pumping channel therebetween. Collisions of gas molecules in the pumping channel with the rotor rotating at a very high speed cause gas in the channel to be pumped from the inlet to the outlet of the channel itself.

With reference to FIG. 1, between 1920-1930 Karl Manne Georg Siegbahn developed a molecular pumping device 10, wherein the pumping action is obtained through the cooperation of a rotor disk 20 having smooth surfaces integral with a rotating shaft 30 with a pair of stator bodies 40, 50, each facing a rotor disk surface and provided with a corresponding spiral-shaped groove 60 open towards the respective surface of the rotor disk and defining therewith a corresponding pumping channel.

The Siegbahn patent GB 332,879 discloses an arrangement of the above-mentioned kind. The gas to be pumped, entering through an inlet 70 at the outer periphery of each pumping groove, flows in both spiral channels in centripetal direction, i.e. from the outer periphery towards the center of the pumping grooves, as indicated by arrows CP. In this case two spiral pumping channels in parallel are to be considered; the gas flows in both channels in centripetal direction.

According to Siegbahn, in order to control the resistance of the gas pumped through the spiral channels 60, the cross-section area of these channels is reduced from the outer periphery of the stator bodies towards their center, in accordance with the reduction of the tangential speed of the disk, in the direction of the gas flow.

U.S. Pat. No. 6,394,747 (M. Hablanian) discloses a vacuum pump having reduced overall size and weight utilizing for this purposes a pair of Siegbahn-type pumping stages connected in series rather than in parallel.

According to U.S. Pat. No. 6,394,747 disclosure, a rotor disk having smooth surfaces is placed between a first stator disk and a second stator disk. Each stator disk is provided with a spiral groove open towards the respective surface of the rotor disk and defining therewith a corresponding pumping channel. At the beginning, the gas to be pumped flows between the first stator disk and the rotor disk in centrifugal direction, from the center to the outer periphery of the rotor disk, and then between the second stator disk and the rotor disk in centripetal direction, i.e. from the outer periphery to the center of the rotor disk.

The cross-section area of the groove defining the pumping channel in the first stator disk, where the gas flows in centrifugal direction, is reduced from the center to the outer periphery, while the cross-section area of the groove defining the channel in the second stator disk, where the gas flows in centripetal direction, is reduced from the outer periphery to the center. In this way the cross-section area of the grooves is always reduced in the direction of the flow and in this way, the U.S. Pat. No. 6,394,747 aims at optimizing both the pumping speed and the compression ratio.

In known Siegbahn-type pumping stage, having the above-mentioned geometric configuration generates the risk of internal compressions and successive re-expansions and corresponding power losses, especially in applications with important flow rates. Therefore, the main object of the present invention is to provide a spiral pumping stage for vacuum pump, which allows to overcome the above-mentioned drawback and to reduce power losses, especially when several stages are connected in series. This and other objects are achieved by a spiral pumping stage as claimed in the appended claims.

SUMMARY OF THE INVENTION

A pumping stage according to the present invention comprises a spiral pumping channel that is designed so that the volumetric channel speed (L/s), given by the product of the channel cross-section area and half the rotor velocity normal to the aforesaid area, is substantially constant throughout the pumping channel.

The pumping stage comprises a stator body having at least one spiral channel on a first surface, the cross-section area of this channel is reduced from the center to the outer periphery of the body so as to maintain the product of the channel cross-section area and the rotor velocity normal to the aforesaid area (i.e. the internal gas flow velocity) constant, irrespective of whether the gas flows through the channel in a centripetal or centrifugal direction.

According to a preferred embodiment of the invention, the pumping stage comprises a stator body having at least one spiral channel on a first surface, wherein the gas flows in a first direction, and at least one further spiral channel on its opposite surface, wherein the gas flows in a second direction opposite to the first direction, the cross-section area of both these channels is reduced from the center to the outer periphery of the disk so as to maintain the constant internal channel speed. Thus, the variation of the cross-section area of the grooves defining the spiral channel of the pumping stage stator body is designed on the grounds of purely geometrical reflections, independently from the advancing direction of the gas flow.

It is evident to the person skilled in the art that the above-mentioned structural feature, in addition to reducing power losses, also constitutes a remarkable advantage with respect to simplicity and cost reduction during the manufacturing process, since all the stator bodies can be made identical, except for the winding direction of the spiral, without regard to whether they are used in centripetal or centrifugal pumping stages.

Advantageously, the pumping stage according to the invention can be used in a vacuum pump in combination with other pumping stages, of the same kind or of a different kind. For example, the pumping stage can be provided downstream of a plurality of turbomolecular axial pumping stages. Also, the pumping stage according to the invention can be provided upstream of a Gaede pumping stage and/or regenerative pumping stage.

According to first preferred application of the invention to a vacuum pump, a plurality of pumping stages are connected in series so that the gas flows through the pumping stages in centripetal and centrifugal direction alternately.

According to a second preferred application of the invention to a vacuum pump, a plurality of pumping stages are connected in parallel so that the gas to be pumped flows through these channels in parallel in centrifugal direction.

According a third preferred application of the invention to a vacuum pump, a plurality of pumping stages are connected in parallel so that the gas to be pumped flows through these channels in parallel in centripetal direction.

BRIEF DESCRIPTION OF THE DRAWINGS

Further advantages and features of the invention will be evident from the detailed description of some preferred embodiments of the invention, given by way of non-limiting example, with reference to the attached drawings, wherein.

DETAILED DESCRIPTION OF THE INVENTION

Figure 1:
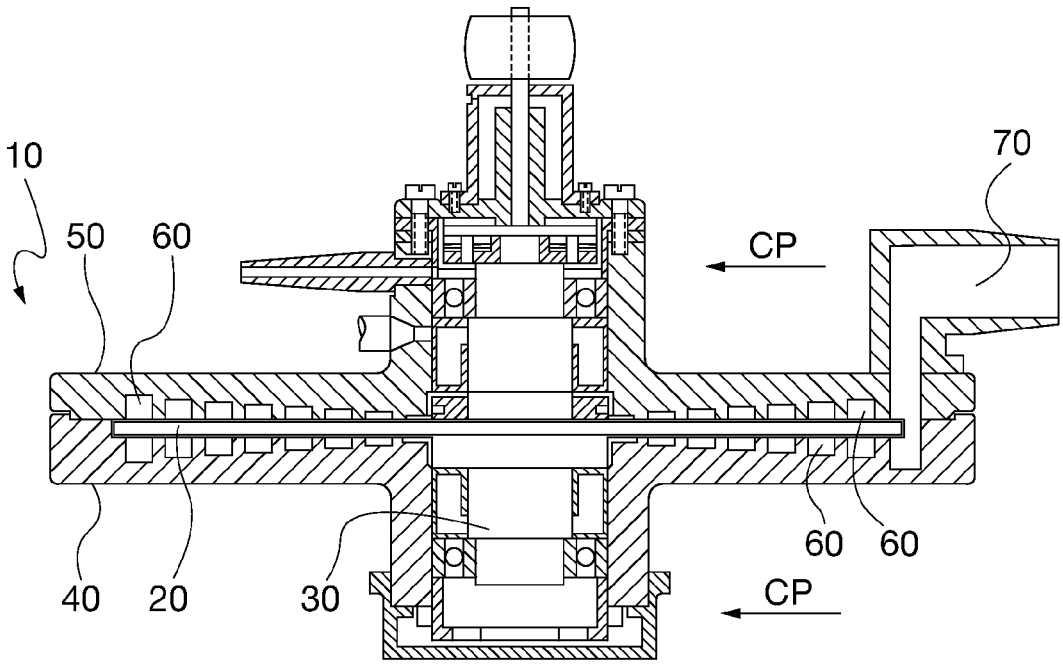
Fig. 1 (PRIOR ART)
FIG. 1 is a cross-sectional view of a known Siegbahn-type pump.
Figure 2A:
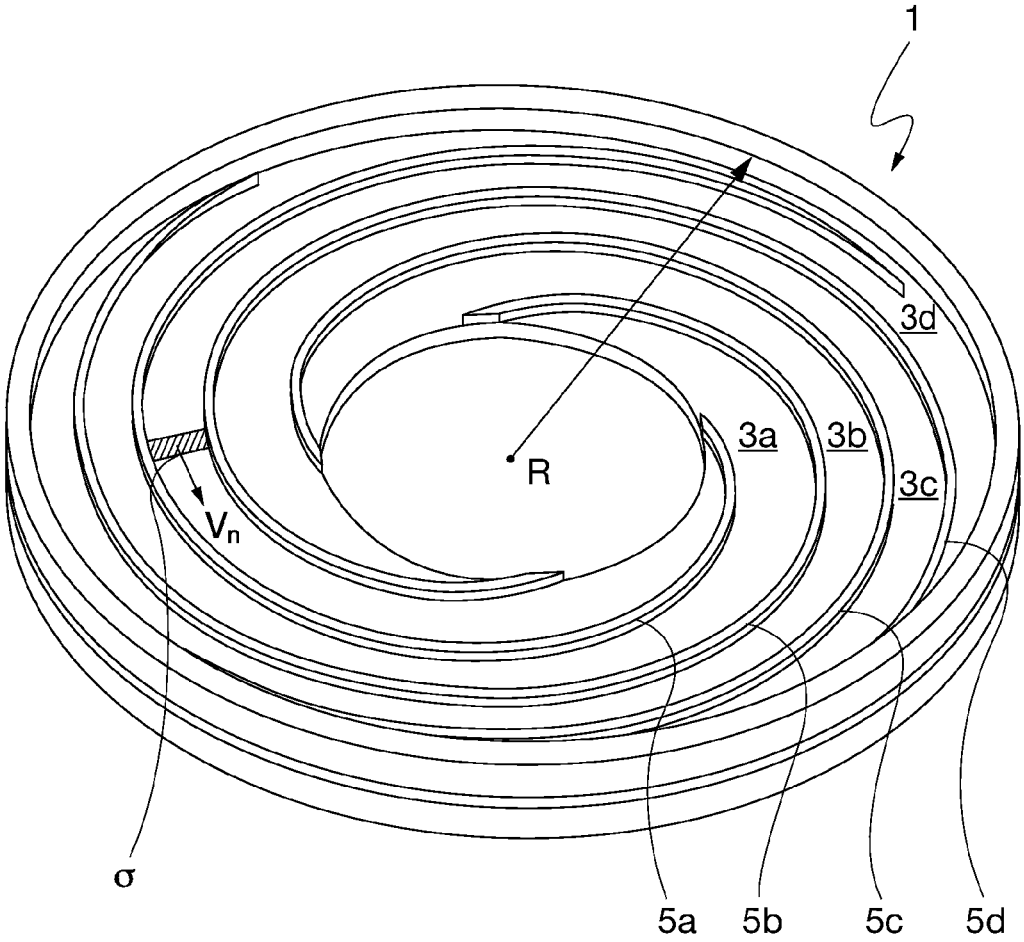
FIG. 2*a* is a perspective view of a stator body of a pumping stage according to the present invention.

With reference to FIGS. 2*a* though 2*c*, the pumping stage comprises a rotor disk 7, 7' having smooth surfaces cooperating with a stator body 1, which is provided with a plurality of spiral channels 3*a*, 3*b*, 3*c*, 3*d*, on the surface facing said rotor disk 7,7'. These spiral channels are connected in parallel and separated from each other by corresponding spiral ribs 5*a*, 5*b*, 5*c*, 5*d*.

The cross-section area σ of channels 3*a*, 3*b*, 3*c*, 3*d* is reduced from the center to the outer periphery of disk 1, i.e. as the distance R from the center of stator body 1 increases. More particularly, as known, the rotor velocity $V_T=\omega R$ is reduced concordantly with radius R from the outer periphery towards the center of the stator body.

According to the invention, the cross-section area σ of channels 3*a*, 3*b*, 3*c*, 3*d* varies so that, the volumetric channel speed S is constant, according to which $$S=V_n\times\sigma=\text{constant} \tag{1}$$

wherein $V_n$ is half the rotor velocity normal to area σ.

More particularly, according to a preferred embodiment of the invention, the shape of the spiral channels of the stator body 1 is defined so that along each spiral channel the following condition is always satisfied:

$$S = 2\pi\omega H(R)R^2\frac{\frac{dR}{Rd\phi}}{1+\left[\frac{dR}{Rd\phi}\right]^2} = \text{CONSTANT} \tag{2}$$

wherein $\omega=V_T/R$ is the rotor angular velocity;

H(R) is the height of the channel, possibly variable as a function of R;

ϕ is the winding angle of the channel spiral.

It will be evident to an expert in the field that a spiral pumping stage whose channel has a shape determined by the values of R and ϕ, which—although they do no represent an exact solution of the equations (1) and (2)—are in any case a good approximation thereof, still falls within the scope of protection of the present invention. In particular, a spiral pumping stage wherein R and ϕ have a deviation not higher than ±10% with respect to the exact solution of the equations (1) and (2) set forth above or has a channel speed S which is CONSTANT within a deviation of ±10% along the channel itself, allows to effectively reach the objects of the present invention.

According to a first order approximation of the above equation and in order of the manufacturing simplification for a channel with constant height H, the channel shape is defined by:

$$S = 2\pi\omega\frac{RdR}{d\phi} = \text{CONSTANT.} \tag{3}$$

By integration, it is obtained $$\frac{R^2-R_1^2}{R_2^2-R_1^2} = \frac{\phi}{\phi_o},$$

wherein $R_1$ and $R_2$ are the inner radius and the outer radius of the stator channel, respectively; and $\phi_0$ is the overall winding angle of the spiral (360° in the example of FIG. 2*a*). Therefore, as stated above, by maintaining the volumetric channel speed constant, the risk of internal expansions or compressions is avoided and the power losses are limited.

Figure 2B:
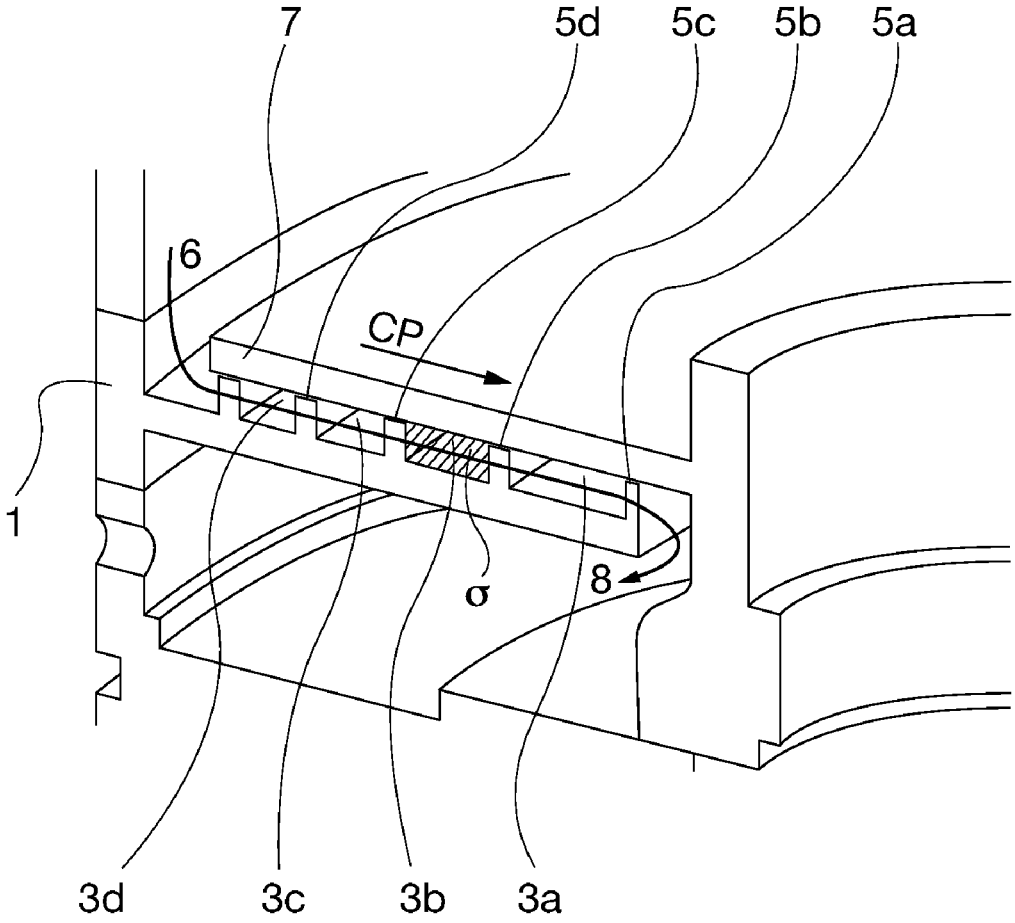
FIG. 2*b* is a cross-sectional view of a first pumping stage incorporating the stator body of FIG. 2*a;*
Figure 2C:
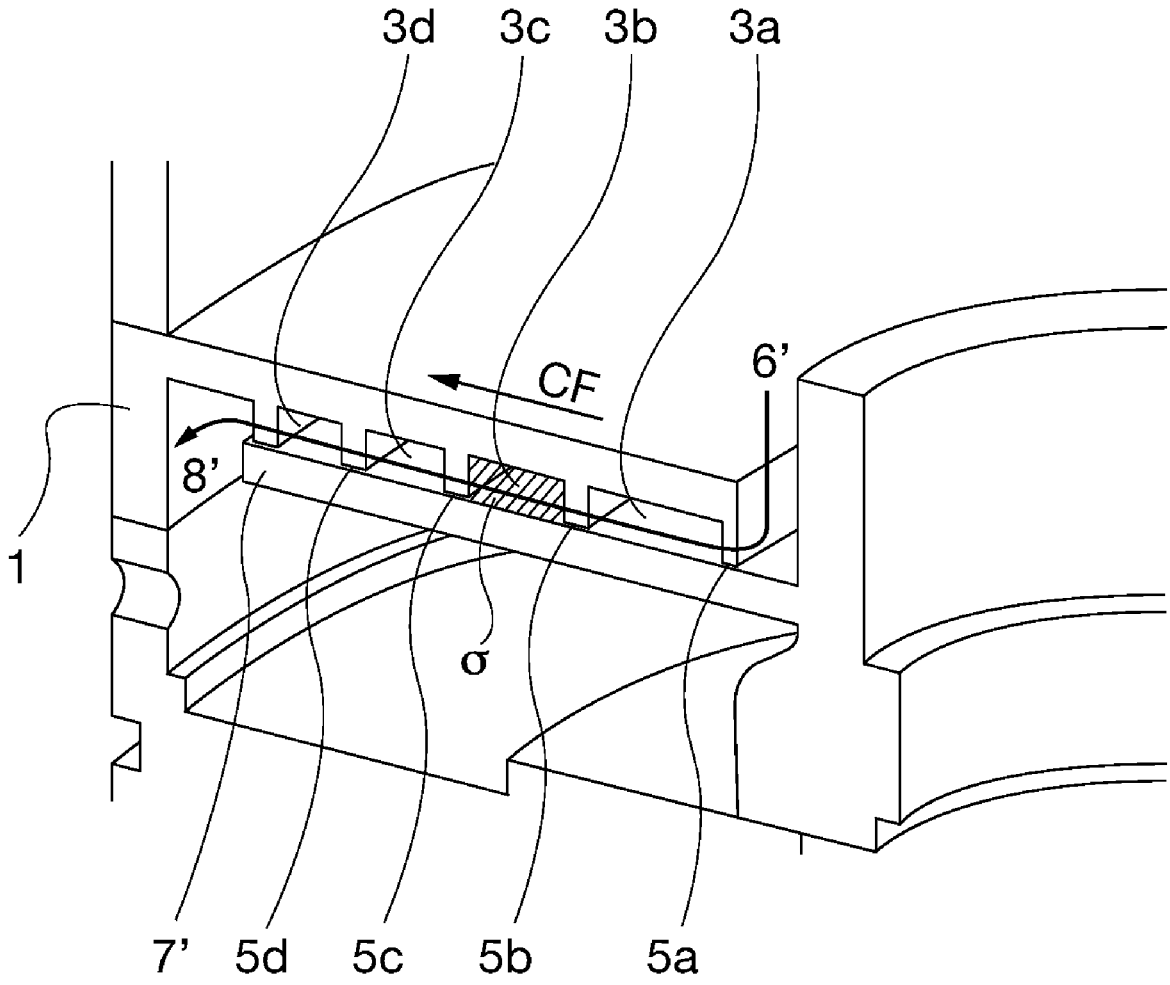
FIG. 2*c* is a cross-sectional view of a first pumping stage incorporating the stator body of FIG. 2*a;*

With reference to FIGS. 2*b* and 2*c*, the geometrical configuration of the pumping stage according to the invention is advantageously independent from the flow direction of the gas to be pumped, since it is defined by the cited mathematical law, whichever the gas flow direction is.

FIG. 2*b* shows a pumping stage where the gas flows through the channel in a centripetal direction. The pumping stage comprises a gas inlet 6 at or close to the outer periphery of the stator body 1 and a gas outlet 8 at or close to the center of the stator body, so that the gas to be pumped flows through channels 3*a*, 3*b*, 3*c*, 3*d* in a centripetal direction, as indicated by arrow CP. According to the invention, the cross-section area of said channels is reduced from the center to the outer periphery of the stator body so that the internal volumetric channel speed is constant along the pumping stages and the equation (1) or (2) or (3) is satisfied.

FIG. 2*c* shows a pumping stage where the gas flows through the channel in a centripetal direction. The pumping stage comprises a gas inlet 6' at or close to the center of the stator body 1 and a gas outlet 8' at or close to the outer periphery of the stator body, so that the gas to be pumped flows through channels 3*a*, 3*b*, 3*c*, 3*d* in a centrifugal direction, as indicated by arrow CF. As in the pumping stage shown in FIG. 2*b*, the cross-section area of these channels is reduced from the center to the outer periphery of the stator body so that the internal volumetric channel speed is constant along said pumping stages and the equation (1) or (2) or (3) is satisfied.

Comparing embodiments shown in FIGS. 2*b* and 2*c*, it is evident that the stator bodies can be made identical irrespective of whether they are intended to be used in centripetal or centrifugal pumping stages.

Figure 3:
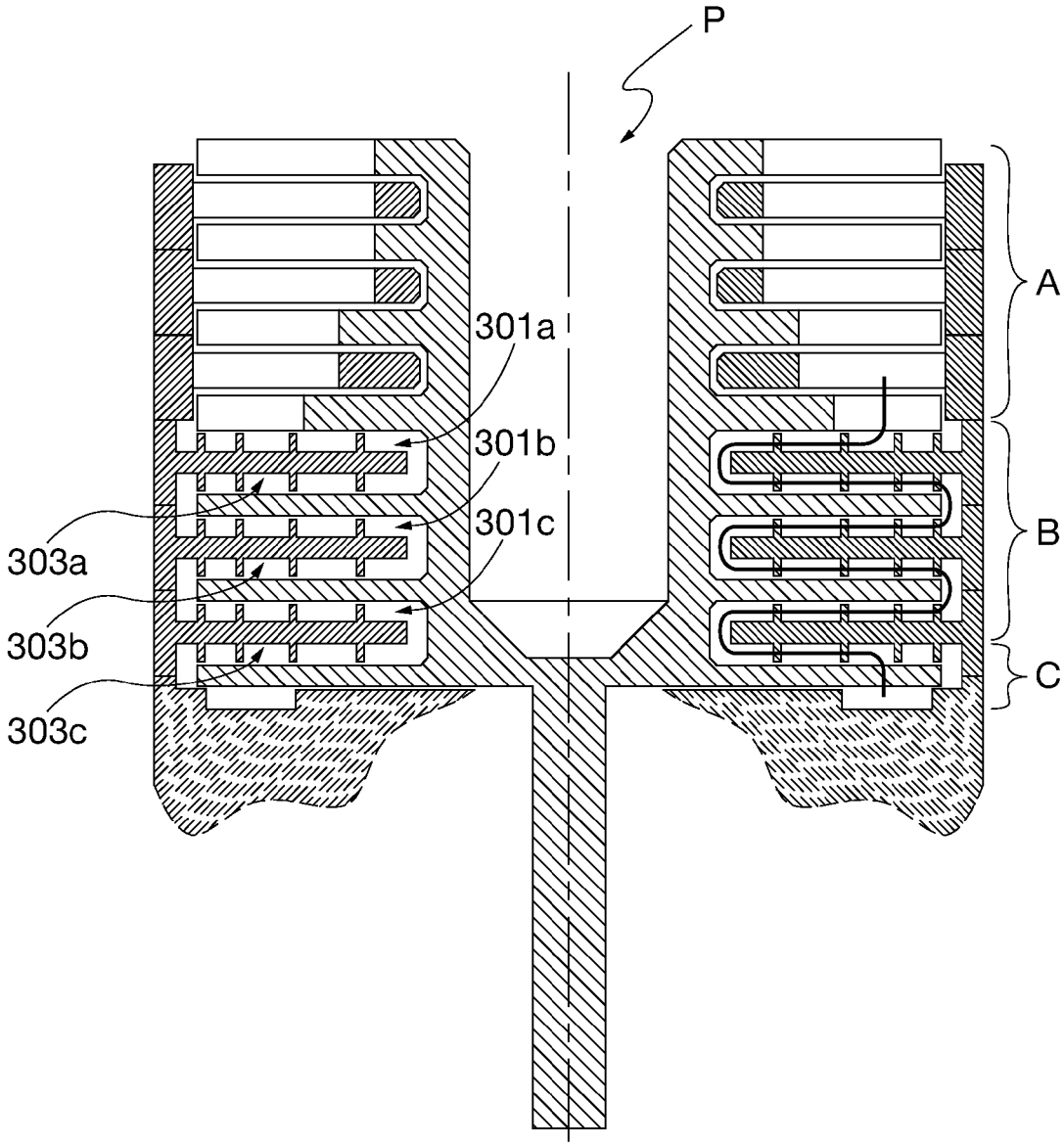
FIG. 3 is a cross-sectional view of a vacuum pump according to a first embodiment of the present invention.
Figure 4:
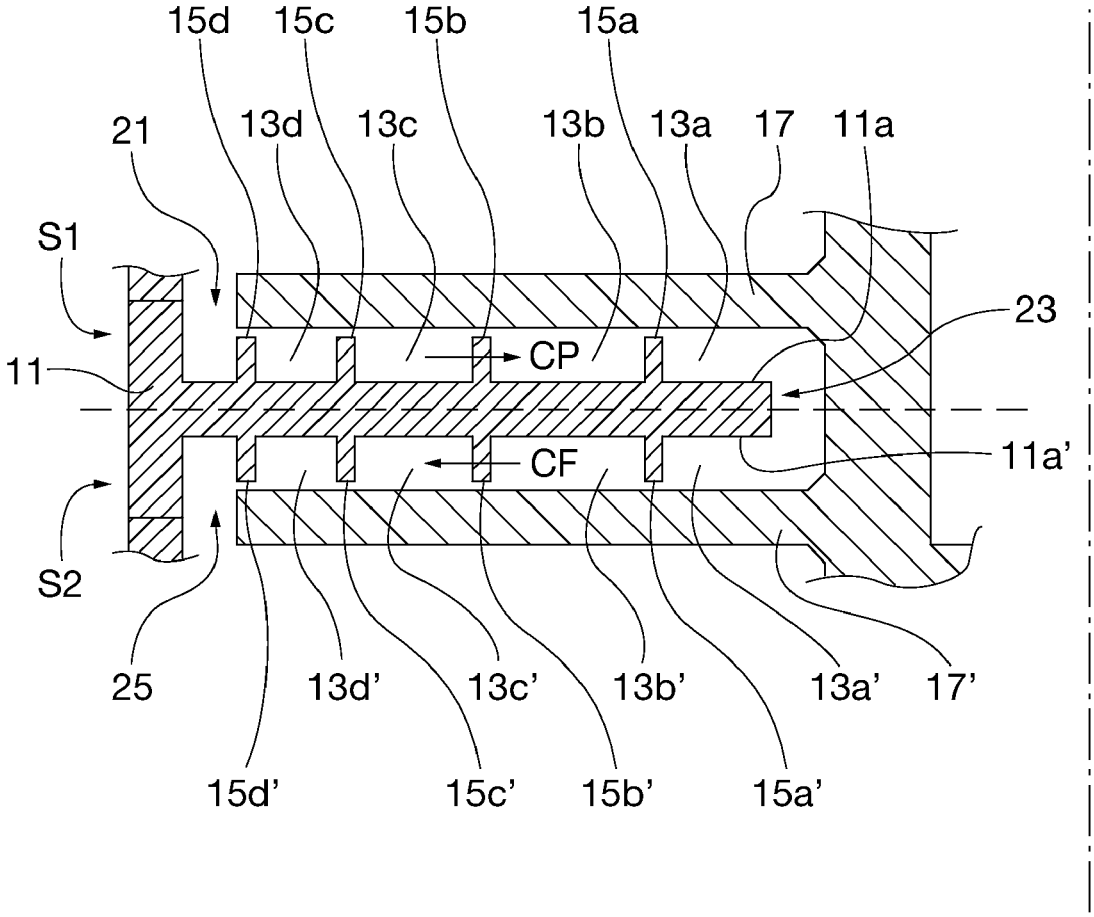
FIG. 4 is an enlarged view of a detail of the vacuum pump of FIG. 3.

With reference to FIGS. 3 and 4 a vacuum pump P is shown according to the present invention. Vacuum pump P comprises an inlet for the gas to be pumped at lower pressure, an outlet for the pumped gas at higher pressure and a plurality of pumping stages provided between said inlet and said outlet. More particularly, it comprises: a first region A at low pressure provided with a plurality of turbomolecular axial pumping stages connected in series; a second region B at intermediate pressure provided with a plurality of spiral pumping stages according to the invention; and a third region C at high pressure provided with one or more Gaede pumping stages (which can possibly be followed or replaced by regenerative stages).

More particularly, the intermediate region B of the vacuum pump P comprises one or more centripetal pumping stages 301*a*, 301*b*, 301*c* according to the invention (three in the example shown in FIG. 3) connected in series with as many centrifugal pumping stages 303*a*, 303*b*, 303*c* according to the invention, alternated with the centripetal stages.

With reference to FIG. 4, a first centripetal pumping stage S1 and a second centrifugal spiral pumping stage S2 according to the invention connected in series are shown in detail.

To this aim, a stator body 11 is provided on both surfaces 11*a*, 11*a*' with spiral channels 13*a*, 13*b*, 13*c*, 13*d* and 13*a*', 13*b*',13*c*',13*d*', separated by corresponding spiral ribs 15*a*, 15*b*, 15*c*, 15*d* and 15*a*', 15*b*' 15*c*', 15*d*', respectively.

A first rotor disk 17 having smooth surfaces is located opposite to a first surface 11*a* of the stator 11 and cooperates therewith for forming a first pumping stage S1 according to the invention. A second rotor disk 17' having smooth surfaces is located opposite to a second surface 11*a*' of the stator 11 and cooperates therewith for forming a second pumping stage S2 according to the invention.

The gas, coming from an inlet 21 placed at the outer periphery of the first pumping stage S1 flows through the first pumping stage S1 in centripetal direction (as indicated by arrow CP), passes through the passage 23 provided at or close to the center of said stator body 11 that connects the two stages S1 and S2 and then flows through the second pumping stage S2 in centrifugal direction (as indicated by arrow CF), successively exiting through an outlet 25 placed at the outer periphery of the second pumping stage S2.

With reference again to FIG. 3, it is evident that the inlet 21 can put a turbomolecular pumping stage or a previous centrifugal spiral pumping stage or a pumping stage of other kind in the region A in communication with the first pumping stage S1 of the region B. The same way, the outlet 25 of the last pumping stage of the region B can put the pumping stage S2 in communication with a successive pumping stage according to the invention or with a Gaede pumping stage or even with a regenerative pumping stage or with a pumping stage of other kind in the region C.

As described above, according to the invention, the cross-section area of channels 13*a*, 13*b*, 13*c*, 13*d* of the first pumping stage S1 and of channels 13*a*', 13*b*', 13*c*', 13*d*' of the second pumping stage S2 is reduced from the center to the outer periphery of the stator body 11 and varies so that the internal pumping speed is constant along the pumping stages S1 and S2 and the condition of equation (1) or (2) or (3) is satisfied.

Figure 5:
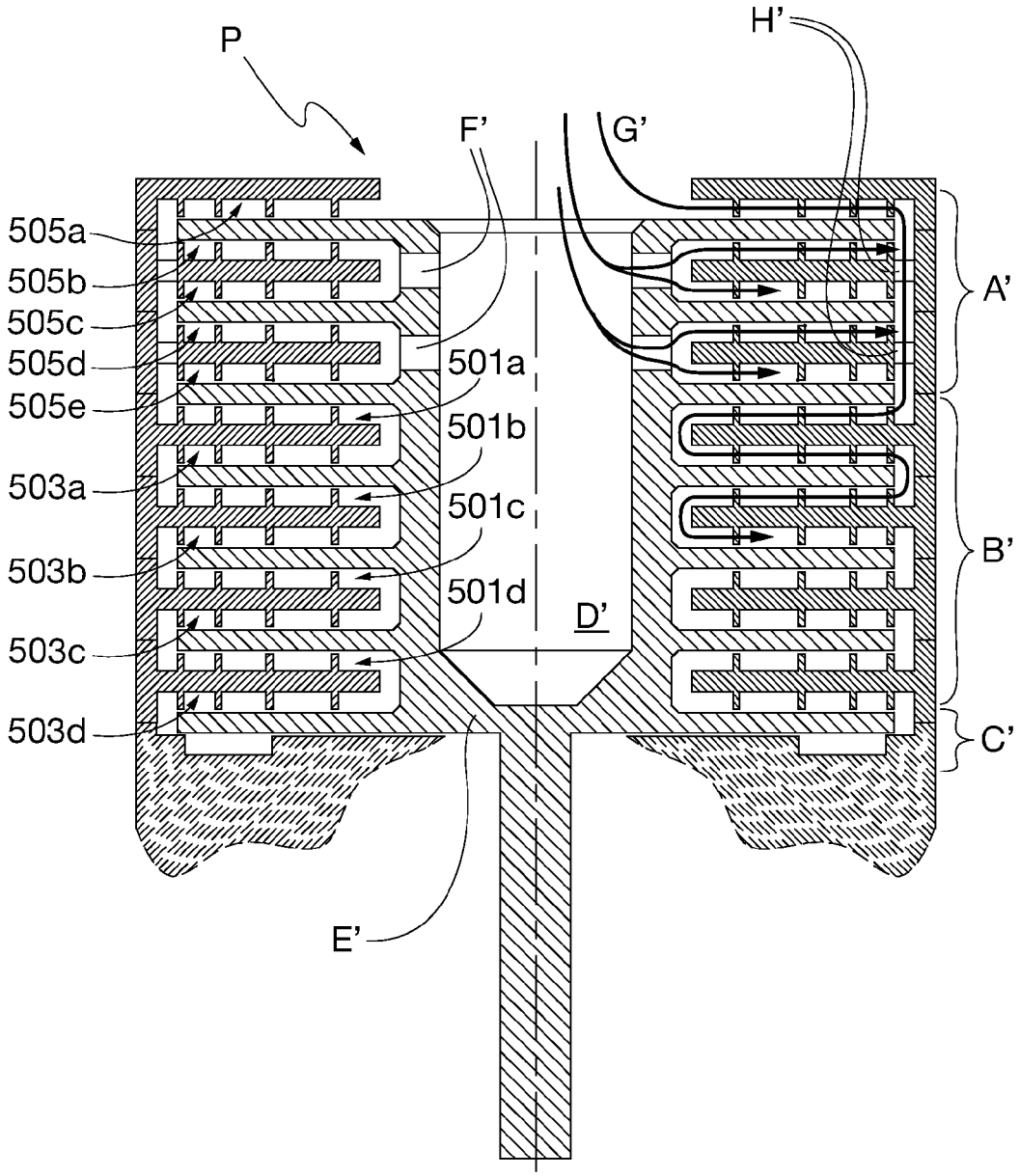
FIG. 5 is a cross-sectional view of a vacuum pump according to a second embodiment of the present invention.

FIG. 5 shows a second embodiment of a vacuum pump P' according to present invention. The pump P' comprises: a first region A' at low pressure that is provided with a plurality of centrifugal pumping stages connected in parallel (five in the example shown in FIG. 5); a second region B' at intermediate pressure that is provided with a plurality of pumping stages according to the invention connected in series; and a third region C' at high pressure that is provided with one or more Gaede pumping stages (which can possibly be followed or replaced by regenerative stages).

More particularly, the second region B' at intermediate pressure of vacuum pump P' comprises one or more centripetal pumping stages 501*a*, 501*b*, 501*c* according to the invention (three in the example shown in FIG. 5) connected in series with as many centrifugal pumping stages 503*a*, 503*b*, 503*c* according to the invention, alternated with said centripetal stages.

Regarding the first region A' at low pressure, for obtaining the centrifugal pumping stages 505*a*, 505*b*, 505*c*, 505*d*, 505*e* connected in parallel, the wall of the central cavity D' of the rotor E' comprises radial through-holes F', so that the gas arriving from inlet G' penetrates inside the cavity D' of the rotor E', passes through the through-holes F' and is subdivided between the several pumping stages of this first region A', being successively collected in a collector defined by holes H'.

With reference to FIG. 5, a further region can be provided upstream to the first region A'. This further region, for example, may comprise a plurality of turbomolecular axial pumping stages. In this case, the outlet of the last turbomolecular stage is connected to the inlet G' of the pumping stages of the first region A'.

Figure 6:
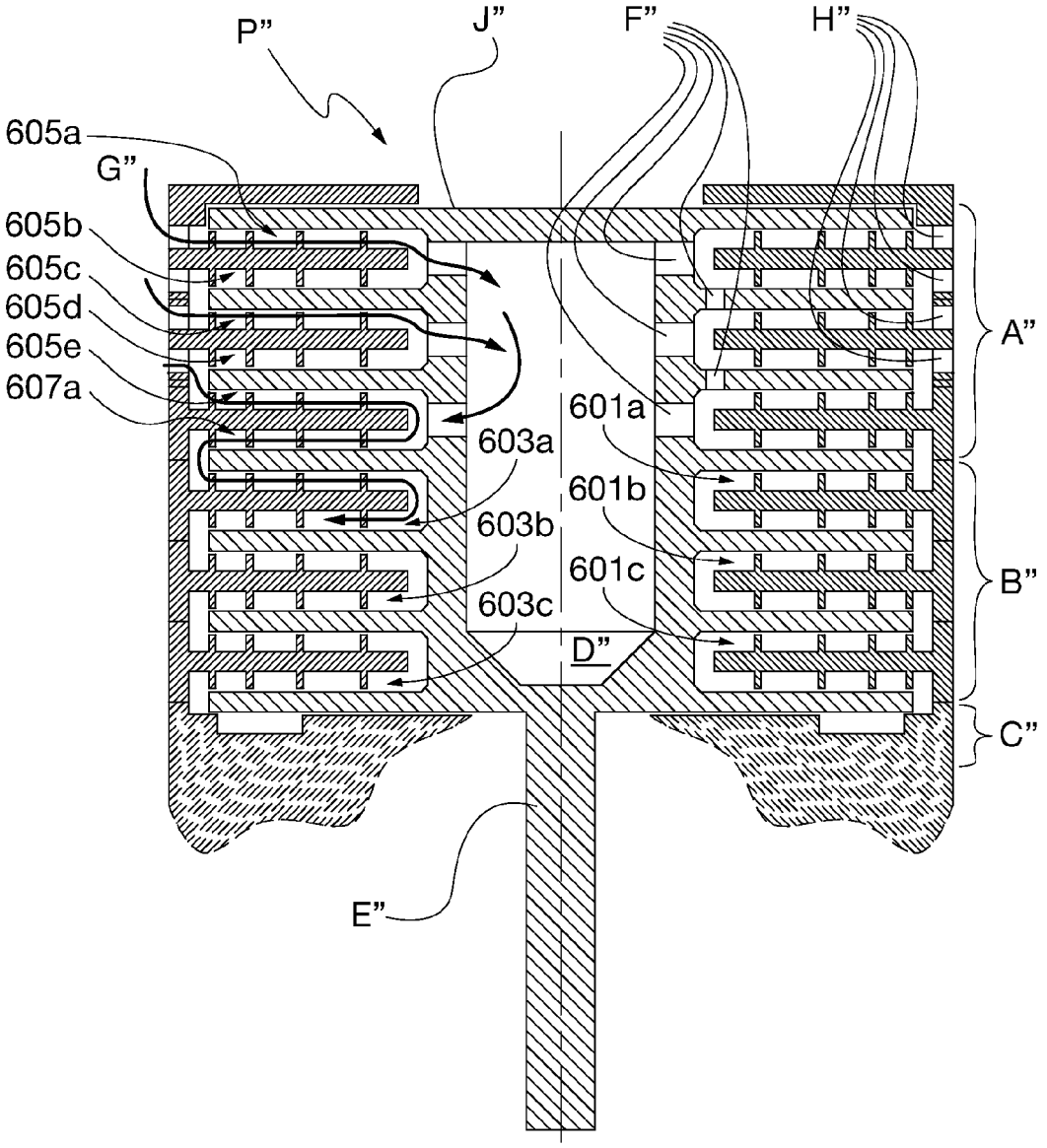
FIG. 6 is a cross-sectional view of a vacuum pump according to a third embodiment of the present invention.

FIG. 6 shows a third embodiment of a vacuum pump P" according to the present invention. The pump P" comprises: a first region A" at low pressure, provided with a plurality of pumping stages according to the invention connected in parallel (five in the example shown in FIG. 6); a second region B" at intermediate pressure, provided a plurality of pumping stages according to the invention connected in series; and a third region C" at high pressure, provided with one or more Gaede pumping stages (which can possibly be followed or replaced by regenerative stages).

More particularly, the second region B" at intermediate pressure of vacuum pump P" comprises one or more centripetal pumping stages 601*a*, 601*b*, 601*c* according to the invention (three in the example shown in FIG. 6) connected in series with as many centrifugal spiral pumping stages 603*a*, 603*b*, 603*c* according to the invention, alternated with said centripetal stages.

In the first region A" being at low pressure, the wall D" of the rotor E" comprises one or more radial through-holes F" and is closed on its upper side by a closing member J", so as to define a collector for the gas. The gas arriving from the inlet G" passes through the radial through-holes H" suitably formed in the wall of the stators of the pumping stages 605*a*, 605*b*, 605*c*, 605*d*, 605*e* is subdivided among the several pumping stages of the first region A", flows through these pumping stages in centripetal direction and converges into the cavity D" of the rotor E", from which it enters successively the region B" at intermediate pressure of the pump P", through a centrifugal pumping stage 607*a*.

With reference to FIG. 6, a further region can be provided upstream to the first region A", the further region may comprise, for example, a plurality of turbomolecular axial pumping stages. In this case, the outlet of the last turbomolecular stage is connected to the inlet G" of the pumping stages of the first region A".

From embodiments shown in FIGS. 3, 5 and 6, it is evident to the person skilled in the art that the pumping stages can be made substantially identical in structure (except for the spiral winding direction), not depending on the direction of the gas flow whether the gas to be pumped flows through them in centripetal or centrifugal direction. This feature remarkably simplifies the manufacturing of the pumps with a corresponding reduction of their manufacturing costs.

Figure 7:
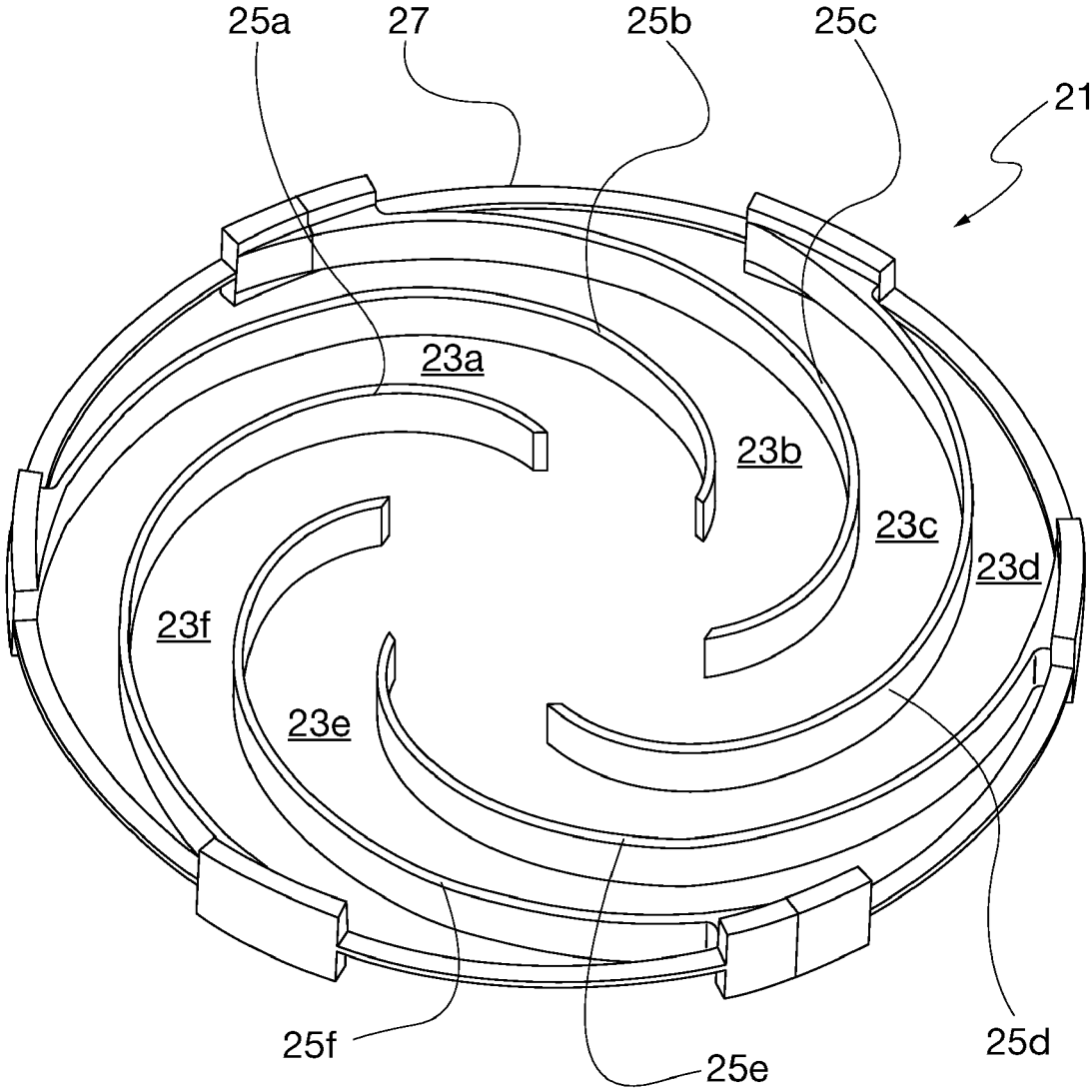
FIG. 7 is a perspective view of a stator body of a pumping stage for different embodiments of the vacuum pump according to the present invention.

With reference to FIG. 7, a stator 21 of a pumping stage that is particularly suitable for applications of the kind of the one shown in FIG. 5 or 6, where a pair of pumping stages are defined on opposite surfaces of the same stator and are connected in parallel. In this case, instead of providing separate channels on the opposite surfaces of the stator body, it is possible to provide a stator body 21 comprising an outer ring 27 that carries cantilever curved vanes 25*a*, 25*b*, 25*c*, 25*d*, 25*e*, 25*f* defining there between corresponding spiral channels 23*a*, 23*b*, 23*c*, 23*d*, 23*e*, 23*f*. The stator body 21 can be located between two rotor disks having smooth lo surfaces and cooperate therewith for forming a pair of either centripetal or centrifugal spiral pumping stages according to the invention connected in parallel through which the pumped gas flows.

It is evident that the described examples and embodiments are in no way limiting. Many modifications and variants are possible without departing from the scope of the invention as defined by the appended claims.

What is claimed is:

1. Molecular spiral vacuum pumping stage comprising:

a rotor disk (7;7') having smooth surfaces and cooperating with a stator body (1;11;21), at least on one surface of the stator body facing said rotor disk comprising at least one spiral channel with a cross-section area (σ), said spiral channel comprising an inlet (6; 6') and an outlet (8; 8') for pumping gas there through, wherein the cross-section area (σ) of said at least one channel is reduced from the center to the outer periphery of said stator body (1;11;21) according to the condition, to be respected within a maximum deviation of ±10%, where:

$$S = V_n \times \sigma = 2\pi\omega H(R)R^2 \frac{\frac{dR}{Rd\phi}}{1+\left[\frac{dR}{Rd\phi}\right]^2} = \text{CONSTANT},$$

wherein

S is the volumetric channel speed $V_n$ is half the rotor velocity normal to area σ, R is the distance from the center of the stator body (1;11; 21);

$\omega = V_T/R$ is the rotor angular velocity;

$V_T$ is the local velocity of the rotor;

H(R) is the height of the channel, possibly variable as a function of R;

ϕ is the winding angle of the channel spiral.

2. Molecular spiral vacuum pumping stage of claim 1, wherein said inlet (6) is provided at or close to the outer periphery of said stator body and said outlet (8) is provided at or close to the center of said stator body, so that the gas flows through said at least one channel in centripetal direction.

3. Molecular spiral vacuum pumping stage of claim 1, wherein said inlet (6') is provided at or close to the center of said stator body and said outlet (8') is provided at or close to the outer periphery of said stator body, so that the gas flows through said at least one channel in centrifugal direction.

4. Molecular spiral vacuum pumping stage of claim 1, wherein said stator body is provided with a plurality of spiral channels (3*a*,3*b*,3*c*,3*d*; 13*a*,13*b*,13*c*,13*d*; 13*a*',13*b*',13*c*',13*d*'; 23*a*,23*b*,23*c*,23*d*,23*e*,23*f*) connected in parallel and separated from each other.

5. Molecular spiral vacuum pumping stage of claim 4, wherein said channels (3*a*,3*b*,3*c*,3*d*; 13*a*,13*b*,13*c*,13*d*; 13*a*', 13*b*',13*c*',13*d*') are defined and separated by corresponding spiral ribs (5*a*, 5*b*, 5*c*, 5*d*; 15*a*,15*b*,15*c*,15*d*; 15*a*',15*b*',15*c*', 15*d*').

6. Molecular spiral vacuum pumping stage of claim 5, wherein the number of said channels (3*a*, 3*b*, 3*c*, 3*d*; 13*a*, 13*b*, 13*c*, 13*d*, 13*a*',13*b*',13*c*',13*d*') is selected so that any radius vector originated at the center of the stator body intercepts at least two of said ribs (5*a*, 5*b*, 5*c*, 5*d*; 15*a*, 15*b*, 15*c*, 15*d*, 15*a*',15*b*',15*c*',15*d*') when moving in the radial direction from the center to the outer periphery of the stator body.

7. Molecular spiral vacuum pumping stage of claim 4, wherein said stator body (21) comprises an outer ring (27) carrying cantilever curved vanes (25*a*, 25*b*, 25*c*, 25*d*, 25*e*, 25*f*) defining therebetween corresponding spiral channels.

8. Molecular spiral vacuum pumping stage of claim 7, wherein the number of said channels (23*a*, 23*b*, 23*c*, 23*d*, 23*e*, 23*f*) is selected so any radius vector originated at the center of the stator body intercepts at least two of said ribs (25*a*, 25*b*, 25*c*, 25*d*, 25*e*, 25*f*) when moving in the radial direction from the center to the outer periphery of the stator body.

9. The vacuum pump of claim 8, wherein said one or more pumping stages being centripetal pumping stages (301*a*, 301*b*, 301*c*) are connected in series with a corresponding number of said one or more pumping stages being centrifugal pumping stages (303*a*, 303*b*, 303*c*), which are alternated with said centripetal stages.

10. The vacuum pump according to claim 8, wherein said one or more pumping stages being one or more centrifugal pumping stages (505*a*, 505*b*, 505*c*, 505*d*, 505*e*) connected in parallel to each other.

11. The vacuum pump according to claim 8, wherein said one or more pumping stages being one or more centripetal pumping stages (605*a*, 605*b*, 605*c*, 605*d*, 605*e*) connected in parallel to each other.

12. Molecular spiral vacuum pumping stage of claim 1, wherein said stator body (11) is provided on both opposite surfaces with at least one spiral channel, the cross-section area (σ) of said channels on both opposite surfaces of said stator body (11) being reduced from the center to the outer periphery of said stator body (1;11;21) according to the condition, to be respected within a maximum deviation of ±10%, where:

$$S = V_n \times \sigma = 2\pi\omega H(R)R^2 \frac{\frac{dR}{Rd\phi}}{1+\left[\frac{dR}{Rd\phi}\right]^2} = \text{CONSTANT}.$$

13. The vacuum pump of claim 12, further comprising a stator body (11) provided on both surfaces (11*a*,11*a*') with spiral channels, a first rotor (17) having smooth surfaces and facing a first surface (11*a*) of said stator (11) and cooperating therewith for forming at least one said centripetal spiral pumping stage and a second rotor (17') having smooth surfaces and facing a second surface (11*a*') of said stator (11) and cooperating therewith for forming said centrifugal pumping stage.

14. A vacuum pump, comprising:

an inlet for the gas to be pumped;

an outlet for the pumped gas;

a plurality of pumping stages located between said inlet and said outlet, one or more pumping stages of said plurality comprising:

a rotor disk (7;7') having smooth surfaces and cooperating with a stator body (1;11;21), at least on one surface of the stator body facing said rotor disk comprising at least one spiral channel with a cross-section area (σ), said spiral channel comprising an inlet (6;6') and an outlet (8;8') for pumping gas there through, wherein the cross-section area (σ) of said at least one channel is reduced from the center to the outer periphery of said stator body (1;11;21) according to the condition, to be respected within a maximum deviation of ±10%, where $$S = V_n \times \sigma = 2\pi\omega H(R)R^2 \frac{\frac{dR}{Rd\phi}}{1+\left[\frac{dR}{Rd\phi}\right]^2} = \text{CONSTANT.}$$

15. The vacuum pump according to any of the claims 8 to 13, wherein said one or more pumping stage is connected in series to a turbomolecular pumping stage.

16. The vacuum pump according to any of the claims 8 to 13, wherein said one or more pumping stage is connected in series to a Gaede pumping stage and/or to a regenerative pumping stage.

* * * * *